US006080090A

United States Patent [19]

Taylor et al.

[11] Patent Number: 6,080,090

[45] Date of Patent: Jun. 27, 2000

[54] FOLDING PORTABLE EXERCISE APPARATUS

[75] Inventors: Joel A. Taylor, Little Rock; Frank Perrien, Bee Branch, both of Ark.

[73] Assignee: Jim D. Eubanks, Beebe, Ark.; a part interest

[21] Appl. No.: 09/206,908

[22] Filed: Dec. 7, 1998

[51] Int. Cl.[7] ..... A63B 21/045

[52] U.S. Cl. ..... 482/121; 482/127

[58] Field of Search ..... 482/121, 127, 482/126, 124, 140, 148, 139

[56] References Cited

U.S. PATENT DOCUMENTS 5,626,545 5/1997 Newman ..... 482/127

FOREIGN PATENT DOCUMENTS 2591496 6/1987 France ..... 482/127

0952026 3/1964 United Kingdom ..... 482/127

*Primary Examiner*—Jerome Donnelly
*Attorney, Agent, or Firm*—Ray F. Cox, Jr.

[57] ABSTRACT

A folding portable exercise apparatus having a padded chest bar and a padded lap bar. Two pairs of length-adjustable telescoping rods connect the bars. Each pair of telescoping rods is joined by a coil spring. An abdominal belt may be fastened around and underneath the user. The device may be used to exercise the upper abdominal muscles, the triceps, the pectoral muscles, and the back and lower abdominal muscles. The device may be disassembled and folded into a compact arrangement for storage and travel by detaching the coil springs from one pair of telescoping rods. This allows the device to be separated into two components. The telescoping rods may be folded so that they lie along the major length of the respective chest bar and lap bar. The belt may then be used to secure the two folded components together producing a compact package approximately the length and width of the chest bar and lap bar.

5 Claims, 9 Drawing Sheets

FIG. 19
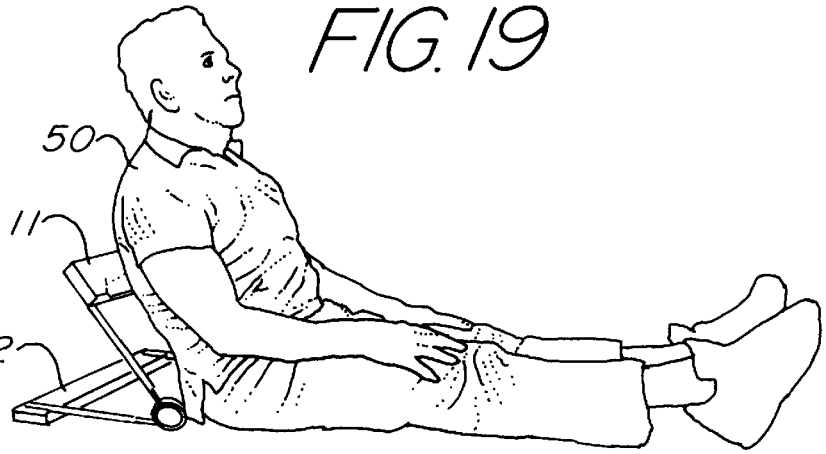
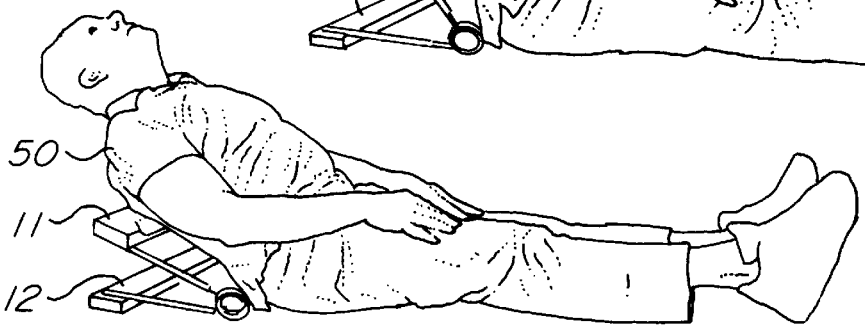
FIG. 20
FIG. 21
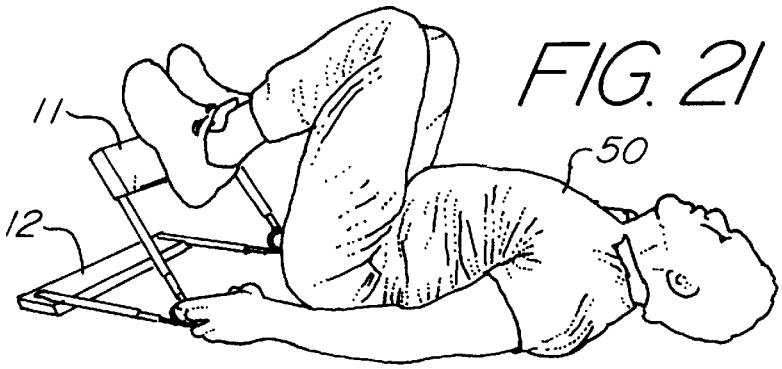
FIG. 22
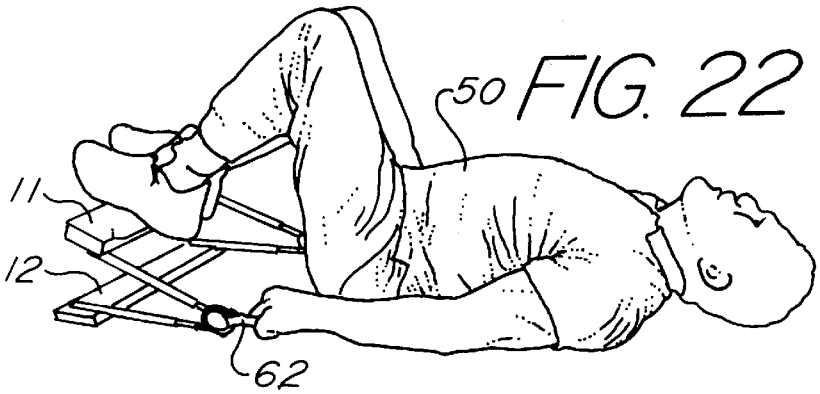

FOLDING PORTABLE EXERCISE APPARATUS

BACKGROUND OF THE INVENTION

The present invention relates to a portable exercise device, and in particular, to a portable exercise device which is foldable for easy storage and transportation.

Medical authorities in recent years have expressed strong admonitions as to the healthful benefits of regular exercise. Regular exercise programs have therefore become a routine part of the daily schedule for many individuals. When events interfere with routine scheduling of exercise activities, such as business travel, the individual may find normal exercise activities difficult or impossible to perform. It is therefore desirable that exercise devices be made easily portable to allow continued exercise regimens by, for example, a busy executive in the office or even when traveling. Such a portable exercise apparatus is desirably small enough to fit in common traveling luggage and able to provide a substantial variety in the types of exercises available to the user. A number of attempts have been made to achieve these objectives.

For example, U.S. Pat. No. 5,669,862 to Sayman discloses a portable exercise device with longitudinal chest and lap bars and a torsion coil spring. The arms connecting the lap and chest bars to the coil spring are adjustable in length. The adjustable arms are fixed in position by tightening wingnuts.

U.S. Pat. No. 5,413,548 to Hoffman is similar in that a pair of padded longitudinal bars are connected by torsion means which may included a coil spring. The arms connecting the longitudinal bars are adjustable by means of a series of spring locked notches. The coil spring may be replaced by springs of greater or lesser strength. A variety of exercises are shown to be possible with the apparatus.

U.S. Pat. No. 5,224,914 to Friedman discloses a portable exercise device employing a padded chest bar and lap bars. The bars are attached to coil springs. An abdominal belt is used to hold the device in place on the user. Such a belt is also shown in U.S. Pat. No. 5,176,622 to Anderson et al.

While the devices described above are disclosed as being portable, a greater degree of compactness is desirable to render the exercise device truly portable to a business traveler or other person desiring ease of transportation with a high degree of exercise capability.

The present invention addresses this need as described below.

SUMMARY OF THE INVENTION

The present invention is a folding portable exercise apparatus. The invention comprises a chest bar that is padded and contoured to lie across the upper chest of the user, and a lap bar which lies across the thighs of the user in a seated position. Two pairs of telescoping rods connect the chest bar and the lap bar. The telescoping rods are adjustable in length to allow for the varying physical sizes of the users. Each pair of telescoping rods is joined by a coil spring. Furthermore, the apparatus is provided with a belt that is attached to the apparatus in the vicinity of each of the coil springs and may be fastened around and underneath the user. The belt is primarily used when the apparatus is employed for exercises in a seated position. In this configuration, the chest bar is placed across the upper chest of the user. The lap bar is placed across the thighs of the user in a seated position. The belt is fastened underneath the user so that the two coil springs are positioned in the vicinity of the user's hip bones.

By using the arms alone to push down on the chest bar, the user may exercise the triceps. Furthermore, when the belt is removed and the device is repositioned vertically, the user may exercise the pectoral muscles by placing the forearms along the outside of the respective bars and compressing the device using the arms and chest muscles alone. Also, the device may be placed on the floor and the user may exercise the back and lower abdominal muscles by assuming a seated position in front of the device with the legs extended. The user may then operate the device by leaning back against the chest bar against the resistance supplied by the floor. Various other exercises are possible with the device.

A key feature of the invention is its ability to be disassembled and folded into a compact arrangement for storage and travel. Wing screws or similar means lock the pair of coil springs into the telescoping rods. By loosening the wing screws, the coil springs may be detached from one pair of telescoping rods. This allows the device to be separated into two components. One component comprises the chest bar, one pair of telescoping rods and the pair of coil springs. The other component comprises the lap bar and the other pair of telescoping rods. The telescoping rods are fastened to the respective chest bar or lap bar by wing nuts or similar means. The telescoping rods are held at right angles to the respective chest bar or lap bar by half cylindrical depressions in the respective chest bar and lap bar. When the telescoping rods are received in these depressions, they may be tightened in place by the wing nuts that tighten down on bolts passing through the bars and telescoping rods. When the wing nuts are loosened sufficiently, the telescoping rods may be folded so that they lie along the major length of the respective chest bar and lap bar. The belt referred to above may then be used to secure the two folded components together producing a compact package approximately the length and width of the chest bar and lap bar. The folded apparatus is then of a size and shape that may be easily stowed in, for example, airline carry-on luggage.

It is therefore an object of the present invention to provide for a portable exercise apparatus that is able to exercise a variety of muscle groups.

It is a further object of the present invention to provide for a portable exercise apparatus that is foldable into a compact form for easy storage and transportation.

These and other objects and advantages of the present invention will be apparent from a consideration of the following detailed description of the preferred embodiments in conjunction with the appended drawings as described following.

BRIEF DESCRIPTION OF THE DRAWINGS

FIG. 19 is a side elevational view of a user employing the present invention to exercise the back and lower abdominal muscles. The view illustrates the starting or finishing position of the exercise.

FIG. 20 is a side elevational view of a user employing the present invention to exercise the back and lower abdominal muscles. The view illustrates the compressed position of the exercise.

FIG. 21 is a side elevational view of a user employing the present invention to exercise the hamstring, quadricep, and gluteal muscles. The view illustrates the starting or finishing position of the exercise.

FIG. 22 is a side elevational view of a user employing the present invention to exercise the hamstring, quadricep, and gluteal muscles. The view illustrates the compressed position of the exercise.

DETAILED DESCRIPTION OF THE PREFERRED EMBODIMENTS

With reference to FIGS. 1–5, the preferred embodiment of the present invention may be described.

Figure 1:
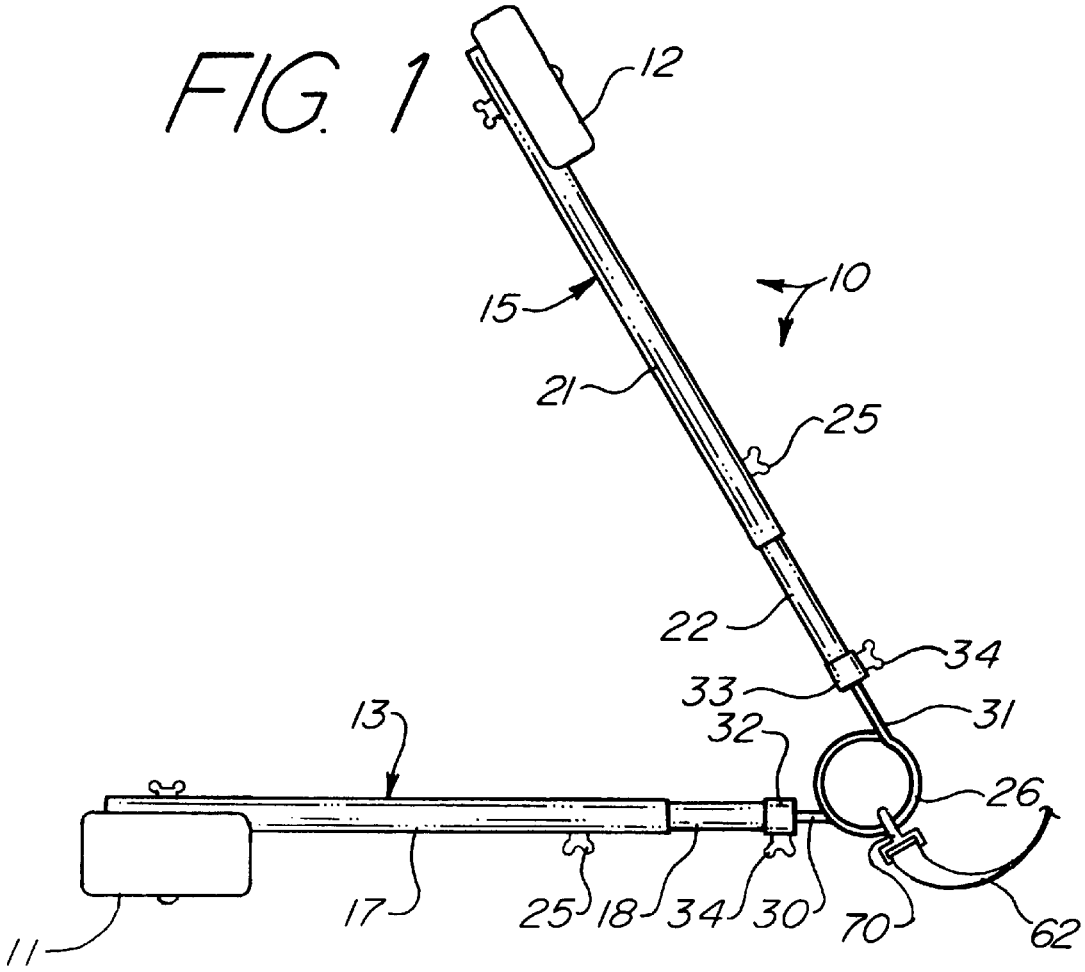
FIG. 1 is a left side elevational view of the present invention.
Figure 2:
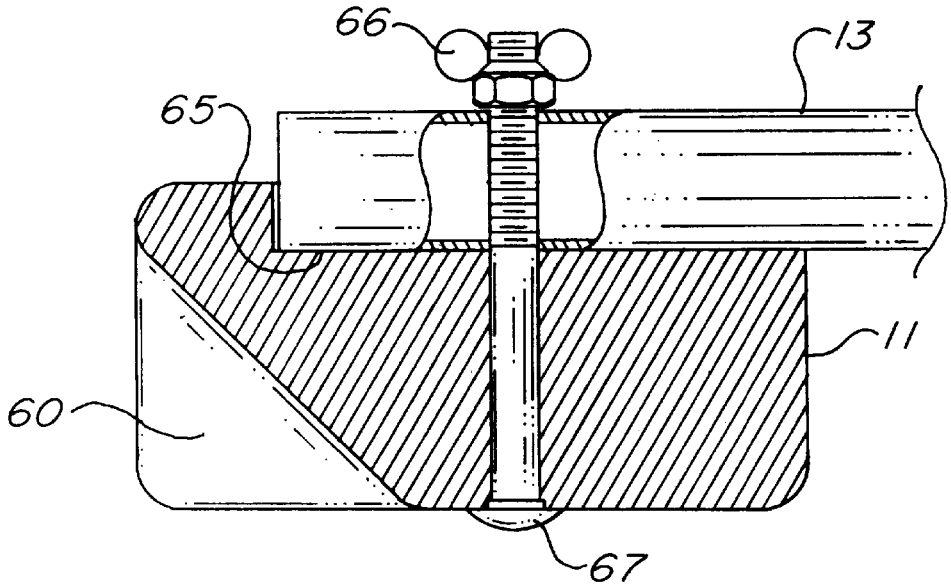
FIG. 2 is an offset sectional left elevational view of the chest bar showing a half cylindrical depression in the chest bar which holds a telescoping rod.
Figure 3:
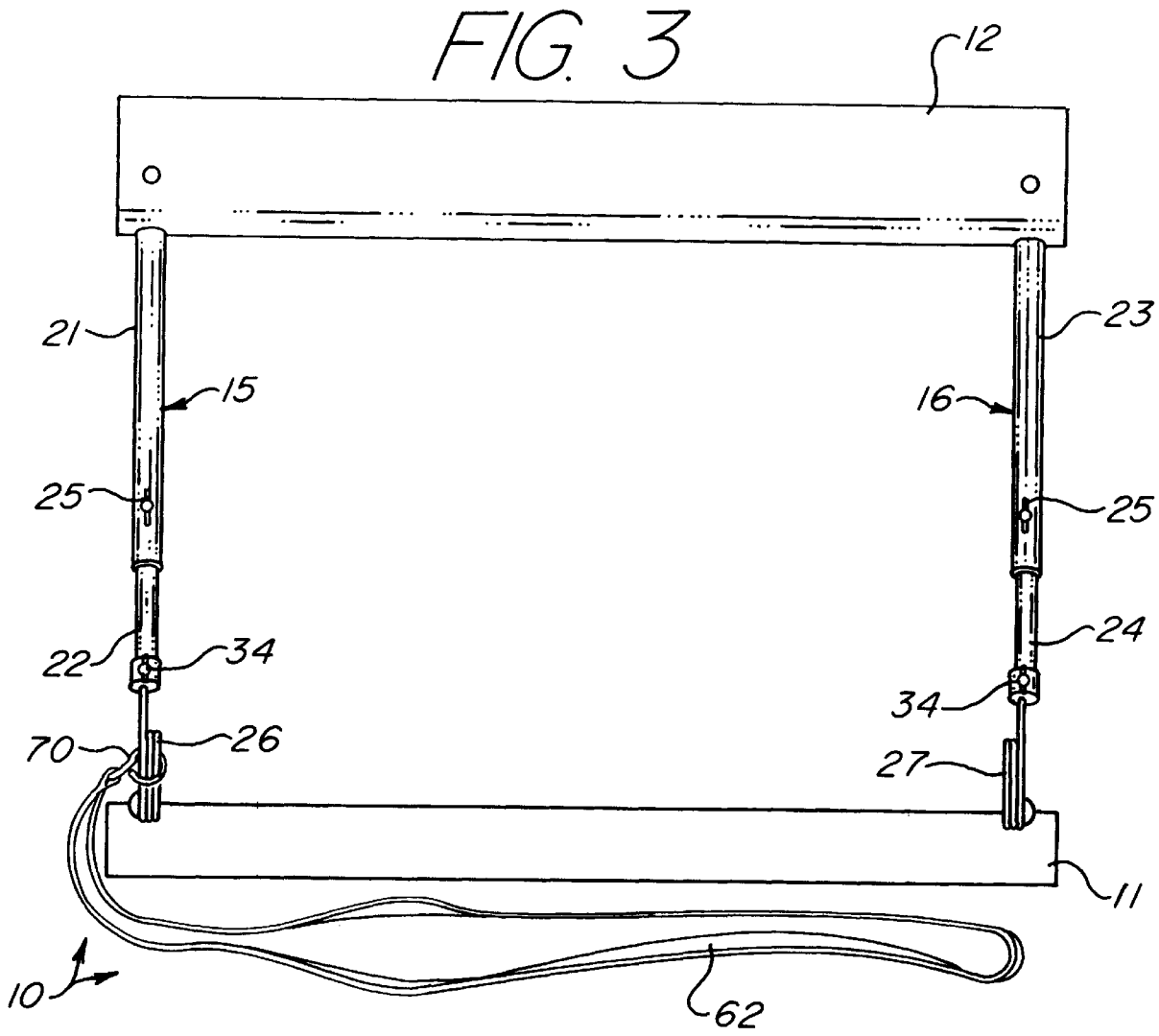
FIG. 3 is a front elevational view of the present invention.
Figure 4:
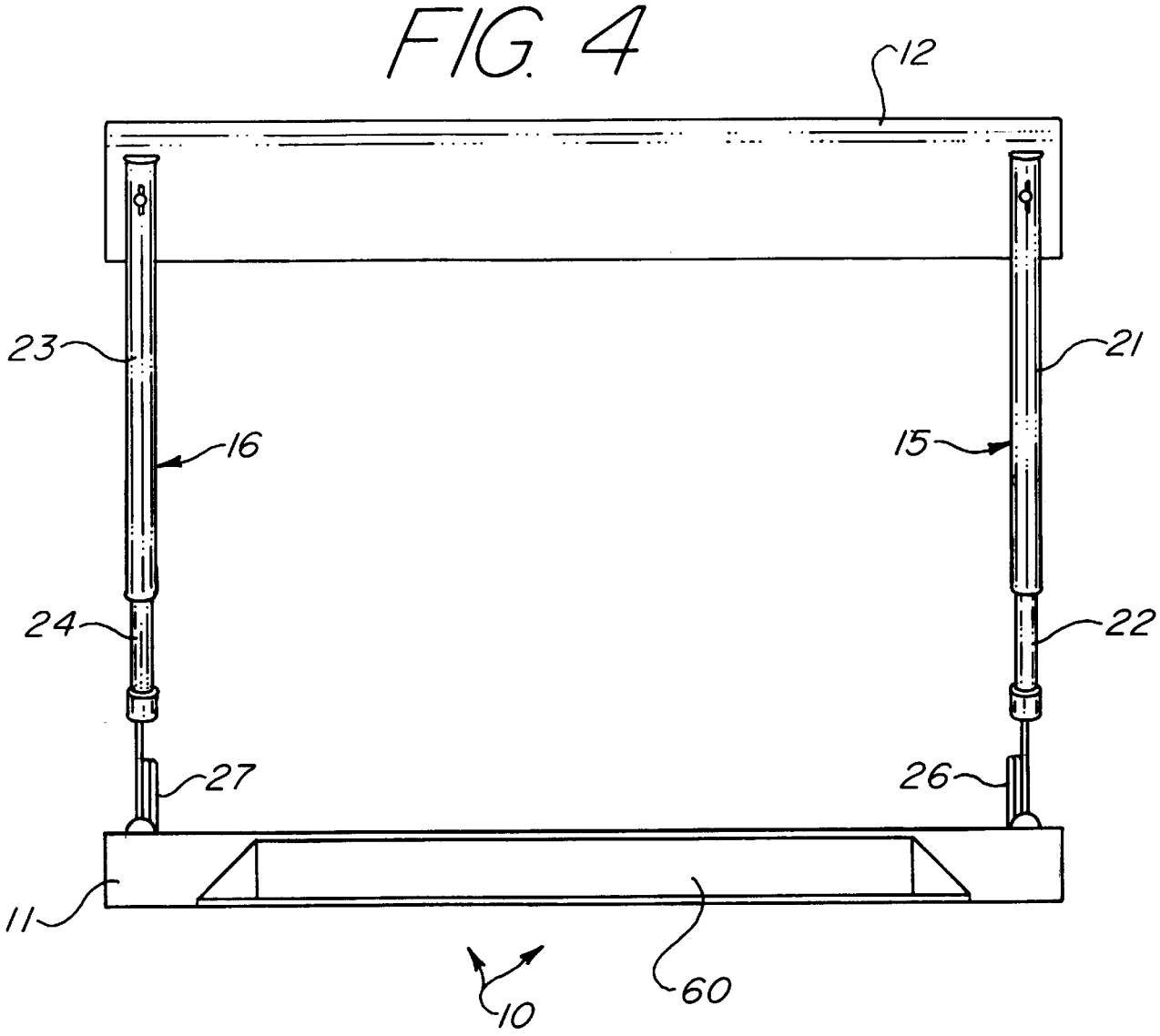
FIG. 4 is a rear elevational view of the present invention.
Figure 5:
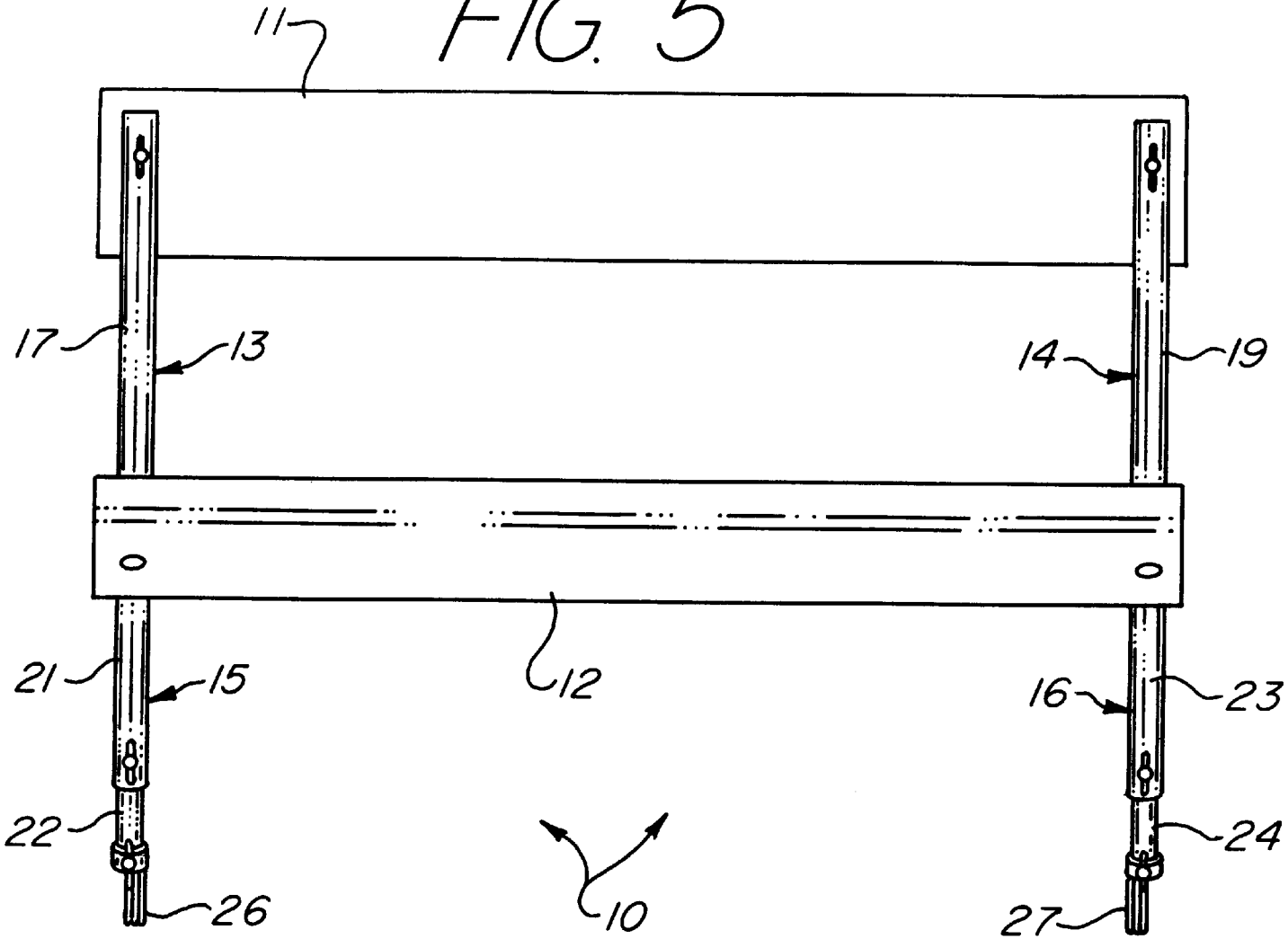
FIG. 5 is a top plan view of the present invention.

The present invention is a folding portable exercise device 10 as shown generally in FIGS. 1, 3, 4, and 5. The invention comprises a chest bar 11 that is desirably padded and contoured to lie across the upper chest of the user 50, and a lap bar 12 which lies across the thighs of the user 50 in a seated position. A form of countoured area 60 is shown in FIGS. 2 and 4. Other forms of countouring may be employed in the invention.

Two pairs of telescoping rods 13, 14, 15, 16 connect the chest bar 11 and the lap bar 12. One pair of telescoping rods 13, 14 connect to the chest bar 11, and the other pair of telescoping rods 15, 16 connect to the lap bar 12. The telescoping rods 13, 14, 15, 16 are adjustable in length to allow for the varying physical sizes of the users. Each telescoping rod 13, 14, 15, 16 is provided with a respective outer cylindrical member 17, 19, 21, 23 in which a respective inner cylindrical member is slidably received. Outer cylidrical member 17 is associated with inner cylindrical member 18; outer cylindrical member 21 is associated with inner cylindrical member 22; and outer cylindrical member 23 is associated with inner cylindrical member 24. The inner cylindrical member associated with outer cylindrical member 20 is not shown, but functions in an equivalent manner to the other members as described.

After adjusting the length of each telescoping rod 13, 14, 15, 16, the telescoping rod 13, 14, 14, 16 may be locked into the desired length by a locking screw 25, which is threadedly received in respective outer cylindrical members 17, 21, 23 so as to bear on respective inner cylindrical members 18, 22, 24. Outer cylindrical member 19 cooperates fashion with its respective inner cylindrical member (not shown). The locking screw 25 may be a wing screw or similar device easily operated manually by the user 50.

Each pair of telescoping rods 13, 15 or 14, 16 is joined by a coil spring 26, 27. Each coil spring 26, 27 is detachably mounted to the respective telescoping rods 13, 15, or 14, 16. With respect to FIG. 1 the attachment of the coil springs 26, 27 is shown with regard to coil spring 26. Coil spring 26 terminates in arms 30, 31 which are received into hollow ends 32, 33 respectively, of inner cylindrical members 18, 22. It should be understood that rotational motion of arms 30, 31 relative to each other acts against the spring force of coil spring 26.

Locking screws 34 are threadedly received into hollow ends 32, 33 so as to bear against arms 30, 31. Locking screws 34 are desirably wing screws or similar devices easily operated manually by the user 50. Coil spring 27 is detachably mounted to telescoping rods 14, 16 in an identical manner.

The device 10 is provided with a belt 28 that is attached by clip-on shackles 70 to the device 10 in the vicinity of each of the coil springs 26, 27 and may be fastened around and underneath the user 50. The belt 28 is primarily used when the device 10 is employed in the seated position. The belt 28 is fastened underneath the buttocks of the user 50 so that the two coil springs 26, 27 are positioned in the vicinity of the hips bones of the user 50.

A key feature of the device 10 is its ability to be disassembled and folded into a compact arrangement for storage and travel. This feature may be described with reference to FIGS. 2 and 6. As described above, locking screws 34 detachably mount the pair of coil springs 26, 27 into the telescoping rods 13, 14, 15, 16. By loosening the locking screws 34, the coil springs 26, 27 may be detached from one pair of telescoping rods; e.g., 13, 14. This allows the device to be separated into two components. One component comprises the chest bar 11, one pair of telescoping rods 13, 14 and the pair of coil springs 26, 27. The other component comprises the lap bar 12 and the other pair of telescoping rods 15, 16.

The two components described above may then be further folded. Each telescoping rod 13, 14, 15, 16 is fastened to a respective chest bar 11 or lap bar 12 as shown in FIG. 2. The attachment will be described following with respect to the chest bar 11 and telescoping rod 13. The attachment between the chest bar 11 and telescoping rod 14, and the attachement between the lap bar 12 and telescoping rods 15, 16 is identical.

Figure 6:
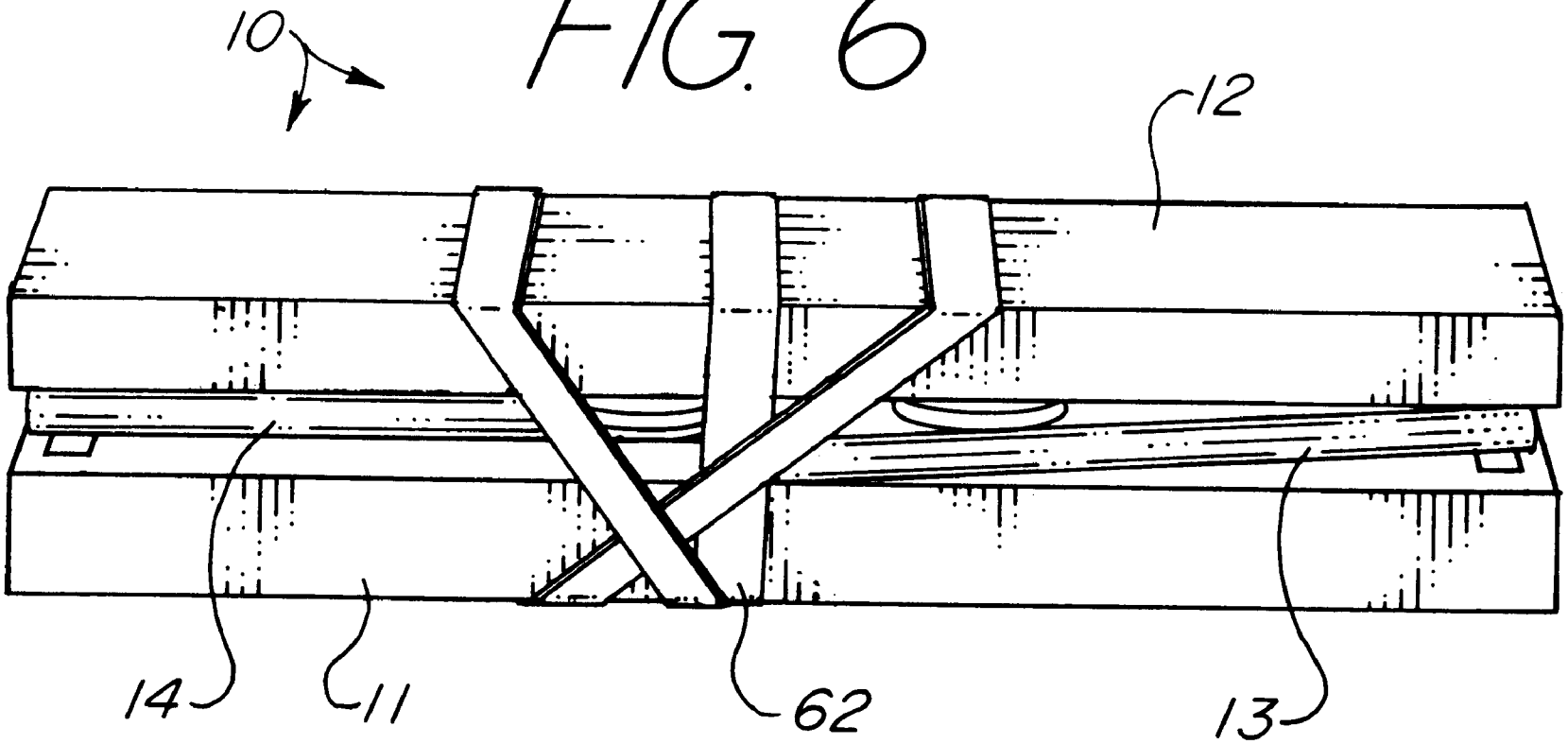
FIG. 6 is a view of the present invention disassembled and packed for transport or storage.

Telescoping rod 13 when the device 10 is fully assembled is held at right angles to chest bar 11 by a half cylindrical depression 65 in chest bar 11. When telescoping rod 13 is received in depression 65, telescoping rod 13 may be fixed in place by wing nut 66 that tightens down on bolt 67 passing through the chest bar 11 and telescoping rod 13. When wing nut 66 is loosened sufficiently, telescoping rod 13 may be lifted out of depression 65 so that telescoping rod 13 may be folded to lie along the major length of chest bar 11 as shown in FIG. 6. Belt 62 may then be used to secure the two folded components together producing a compact package approximately the length and width of chest bar 11 and lap bar 12. The folded device 10 is then of a size and shape that may be easily stowed in, for example, airline carry-on luggage.

By using the compact folding exercise device of the present invention, it is possible to exercise eight major muscle groups.

Figure 7:
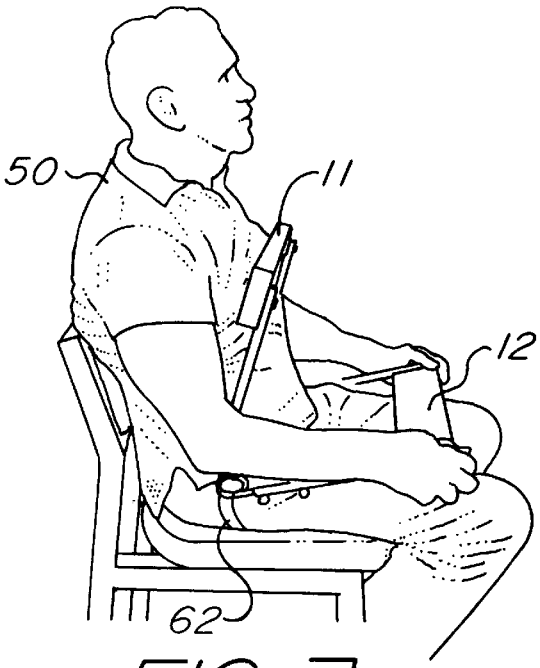
FIG. 7 is a side elevational view of a user employing the present invention to exercise the abdominal muscles. The view illustrates the starting or finishing position of the exercise.
Figure 8:
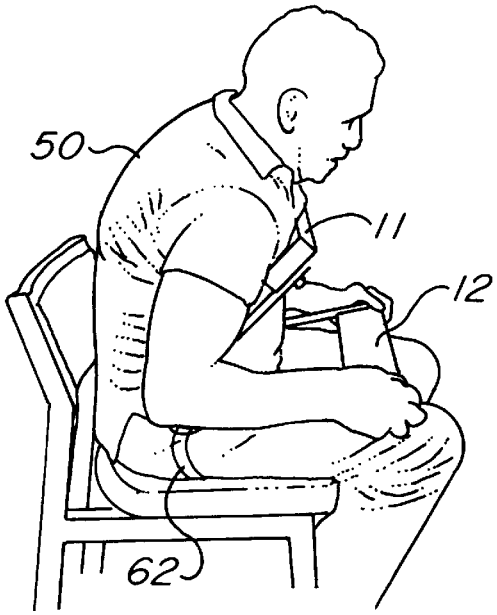
FIG. 8 is a side elevational view of a user employing the present invention to exercise the abdominal muscles. The view illustrates the compressed position of the exercise.

Exercising the abdominals is shown in FIGS. 7 and 8. The user is seated, the device is placed so that the lap bar 12 is resting on the thighs of the user 50 and the chest of the user 50 is resting against the chest bar 11 as shown in FIG. 7. The hands of the user 50 are placed on top of the lap bar 12 and the user bends forward against the chest bar 11 through an approximately 90 degree arc toward the lap bar 12 as shown in FIG. 8. The belt 62 is placed under the user 50 during this exercise.

Figure 9:
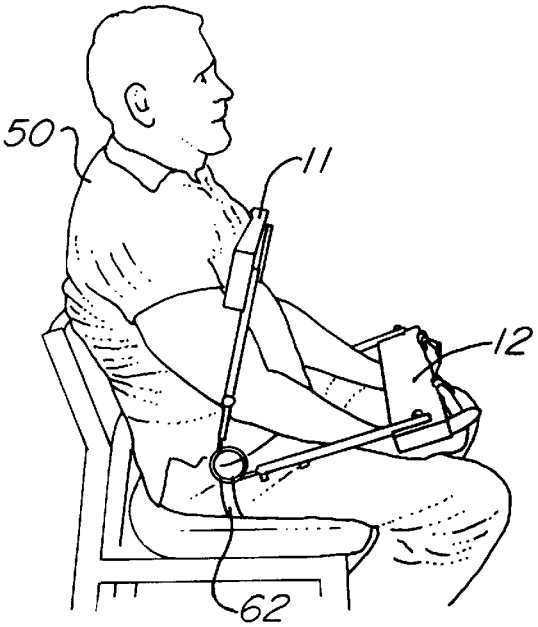
FIG. 9 is a side elevational view of a user employing the present invention to exercise the bicep muscles. The view illustrates the starting or finishing position of the exercise.
Figure 10:
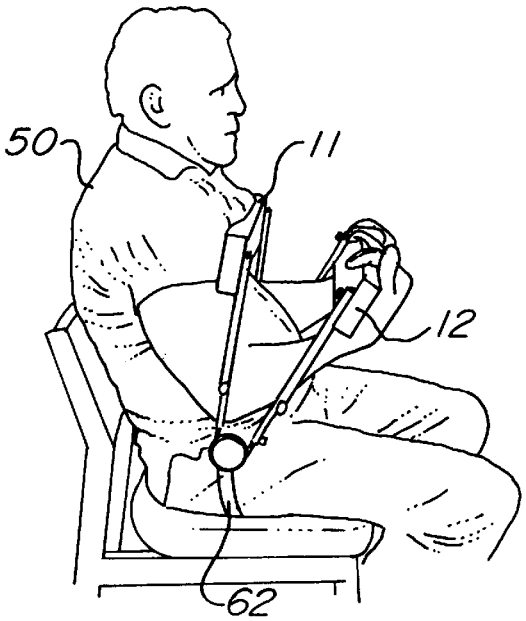
FIG. 10 is a side elevational view of a user employing the present invention to exercise the bicep muscles. The view illustrates the compressed position of the exercise.

Exercising the biceps is shown in FIGS. 9 and 10. The user 50 is again in a seated position with the chest bar 11 against the chest of the user 50. The palms of the user 50 are placed under the lap bar 12 while the belt 62 is fastened under the buttocks of the user 50 as shown in FIG. 9. The lap bar 12 is raised through a 90 degree arc to the chest as shown in FIG. 10.

Figure 11:
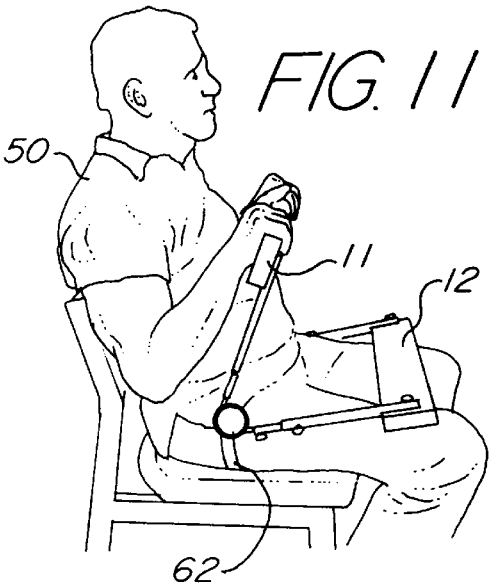
FIG. 11 is a side elevational view of a user employing the present invention to exercise the tricep muscles. The view illustrates the starting or finishing position of the exercise.
Figure 12:
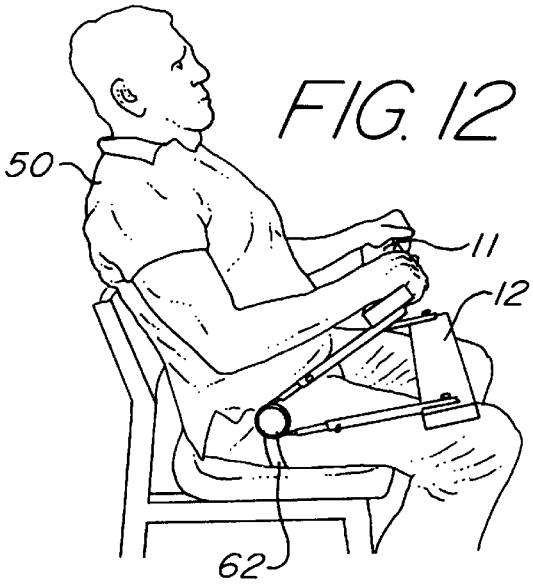
FIG. 12 is a side elevational view of a user employing the present invention to exercise the tricep muscles. The view illustrates the compressed position of the exercise.

Exercising the triceps is shown in FIGS. 11 and 12. The user 50 is in a seated position with the lap bar 12 against the thighs of the user 50, the palms of the user 50 are placed behind the chest bar 11 and using the arms alone the user 50 presses the chest bar 11 down toward the lap bar 12 as shown in FIG. 12. The belt 62 is also used in this exercise.

Figure 13:
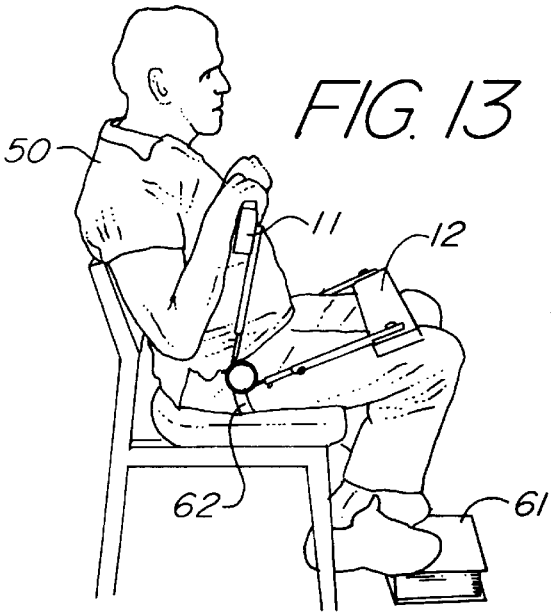
FIG. 13 is a side elevational view of a user employing the present invention to exercise the calf muscles. The view illustrates the starting or finishing position of the exercise.
Figure 14:
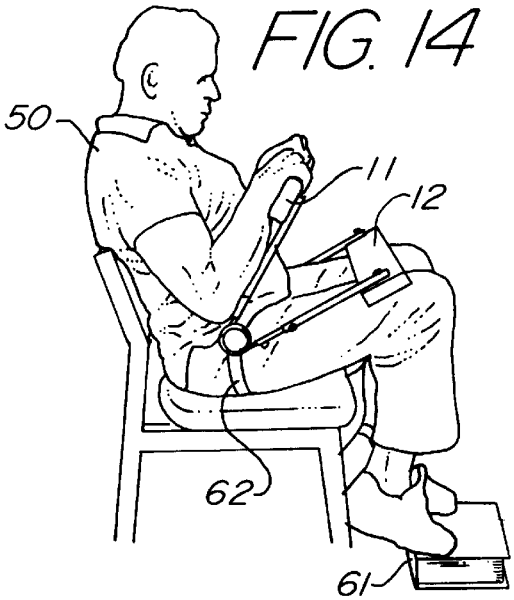
FIG. 14 is a side elevational view of a user employing the present invention to exercise the calf muscles. The view illustrates the compressed position of the exercise.

Exercising the calves is shown in FIGS. 13 and 14. The user 50 is seated with the lap bar 12 against the thighs of the user 50. The user 50 places the balls of the feet on a book 61 or similar item to raise the heels of the feet approximately 3 inches off the floor as shown in FIG. 13. The user 50 places the palms behind the chest bar 11 to provide resistance and the user 50 raises the heels to compress the lap bar 12 toward the chest bar 11 as shown in FIG. 14. The belt 62 may also be fastened beneath the user 50 in this exercise.

Figure 15:
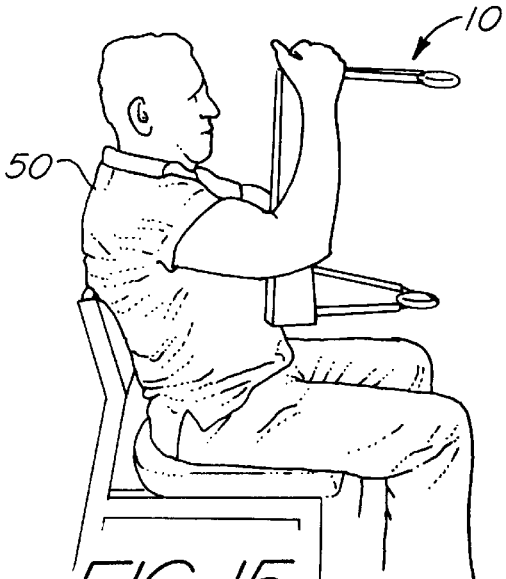
FIG. 15 is a side elevational view of a user employing the present invention to exercise the pectoral muscles. The view illustrates the starting or finishing position of the exercise.
Figure 16:
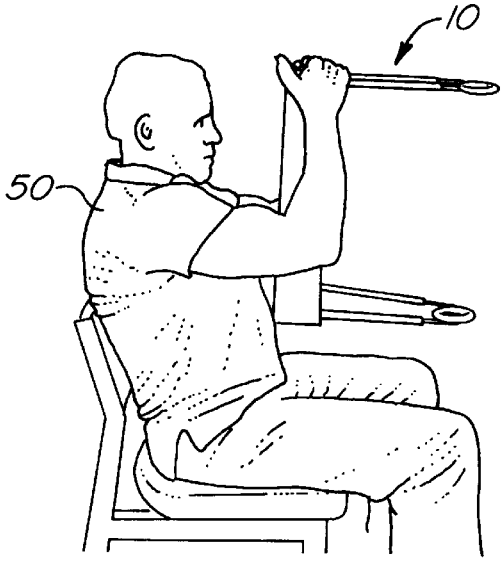
FIG. 16 is a side elevational view of a user employing the present invention to exercise the pectoral muscles. The view illustrates the compressed position of the exercise.

Exercising the pectorals (chest muscles) is shown in FIGS. 15 and 16. The belt 62 is not used in this exercise. The user 50 is seated and the device 10 is turned vertically with the forearms of the user 50 placed along the outer surfaces of the bars 11, 12 as shown in FIG. 15. The user 50 compresses the lap bar 12 toward the chest bar 11 using the chest muscles as shown in FIG. 16.

Figure 17:
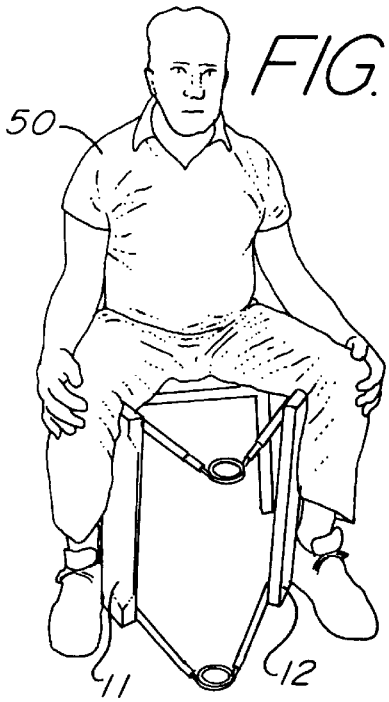
FIG. 17 is a side elevational view of a user employing the present invention to exercise the inner thigh muscles. The view illustrates the starting or finishing position of the exercise.
Figure 18:
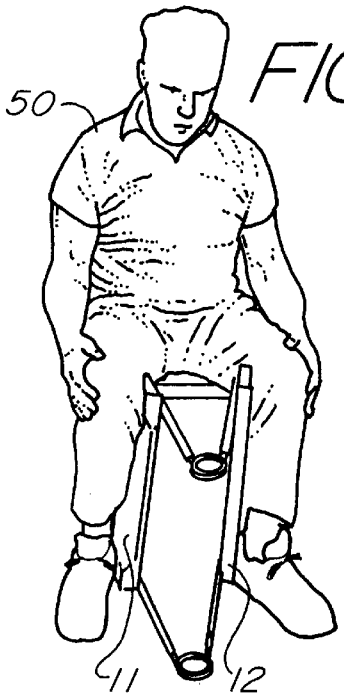
FIG. 18 is a side elevational view of a user employing the present invention to exercise the inner thigh muscles. The view illustrates the compressed position of the exercise.

Exercising the inner thigh muscles is shown in FIGS. 17 and 18. The belt 62 is not used with this exercise. The user 50 is seated and the device 10 is placed on the floor in the vertical position with the bars 11, 12 placed along each shin of the user 50 as shown in FIG. 17. The device 10 is compressed using only the thigh muscles as shown in FIG. 18.

Exercising the back and lower abdominals is shown in FIGS. 19 and 20. The belt 62 is not used in this exercise. The lap bar 12 is placed flat on the floor and the user 50 sits on the floor with the chest bar 11 below the shoulders of the user 50 as shown in FIG. 19. The user 50 reclines against the chest bar 11 as shown as shown in FIG. 20 by tightening the back muscles and then returns to the upright seated position of FIG. 19 by tightening the lower abdominal muscles.

Exercising the hamstring, quadriceps, and gluteals is shown in FIGS. 21 and 22. The belt 62 is not used in this exercise. The lap bar 12 is placed flat on the floor. The user 50 is supine with the knees raised and the feet placed against the chest bar 11 as shown in FIG. 21. The chest bar 11 is compressed toward the lap bar 12 by tightening the hamstring and gluteal muscles as shown in FIG. 22 and then the chest bar 11 is returned to the upright position of FIG. 21 by tightening the quadricep muscles.

The exercises may be performed by the user in a variety of circumstances. For example, the user may be watching television and take advantage of the commercial interruptions for exercise. The first six exercises described above may be performed while seated in front of the television without leaving the chair. The last two exercises require the use of the invention in a supine position but could also be performed without leaving the television set. It should be understood that the invention may also be used in a number of other circumstances, such as use of the invention in hotel room by a business traveler and even by a business person in the office.

The number of repetitions and the number of sets of each exercise may be determined by the user. A recommended regimen is five to ten repetitions of each exercise with the user working up to three sets of repetitions of each exercise.

The present invention has been described with reference to certain preferred and alternative embodiments which are intended to be exemplary only and not limiting to the full scope of the present invention as set forth in the appended claims.

What is claimed is:

1. A folding portable exercise apparatus, comprising:

a first bar having a first longitudinal axis;

a second bar having a second longitudinal axis;

a first pair of telescoping rods each having a proximal end and a distal end, means for pivotally connecting said proximal ends of said first pair of telescoping rods to said first bar allowing movement of said first pair of telescoping rods between a folded position wherein said telescoping rods lie substantially along said first longitudinal axis and an unfolded position wherein said telescoping rods lie substantially at right angles to said second longitudinal axis;

means for locking said first pair of telescoping rods in said unfolded position;

a second pair of telescoping rods each having a proximal end and a distal end, means for pivotally connecting said proximal ends of said second pair of telescoping rods to said second bar allowing movement of said second pair of telescoping rods between a folded position wherein said telescoping rods lie substantially along said second longitudinal axis and an unfolded position wherein said telescoping rods lie substantially at right angles to said second longitudinal axis;

means for locking said second pair of telescoping rods in said unfolded position;

a pair of coil springs, each having a helically wound portion and a first and second projecting arm , said projecting arms diverging from each other at a given acute angle; means for removably connecting each of said first projecting arms to a respective one of said distal ends of said telescoping rods attached to said first bar; and means for removably connecting each of said second projecting arms to a respective one of said distal ends of said telescoping arms attached to said second bar.

2. The folding portable exercise apparatus of claim 1 further comprising an abdominal belt and means for removable attachment of said abdominal belt to said coil springs.

3. The folding portable exercise apparatus of claim 1 wherein said first bar comprises a padded bar contoured to fit the chest of a user.

4. The folding portable exercise apparatus of claim 1 wherein said second bar comprises a padded bar contoured to fit the lap of a user.

5. The folding portable exercise apparatus of claim 1 wherein said means for locking said first and second pairs of telescoping rods in said unfolded position comprises an indentation in each of said first and second bars at each of said proximal ends of said telescoping rods and transverse to said longitudinal axes of said bars, a threaded pin affixed in each of said indentations, said pin passing through an opening in said proximal ends of said telescoping rods allowing pivotal motion of said telescoping rods with respect to said pins and further allowing said distal ends to lie within said indentations in said unfolded position and to lie outside of said indentations in said folded position, and means threadedly received on said threaded pin for tightening said telescoping rods in said unfolded position.

* * * * *